US008013252B2

(12) United States Patent
Daane et al.

(10) Patent No.: US 8,013,252 B2
(45) **Date of Patent: *Sep. 6, 2011**

(54) FLEXIBLE INTERCONNECT CABLE WITH RIBBONIZED ENDS

(76) Inventors: Larry Daane, Wilsonville, OR (US); Arthur Buck, Sherwood, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/345,663

(22) Filed: Jan. 16, 2003

(65) Prior Publication Data

US 2003/0106705 A1 Jun. 12, 2003

Related U.S. Application Data

(63) Continuation of application No. 10/025,096, filed on Dec. 18, 2001, now Pat. No. 6,580,034, which is a continuation-in-part of application No. 09/822,550, filed on Mar. 30, 2001, now abandoned.

(51) Int. Cl.
*H01B 7/00* (2006.01)

(52) U.S. Cl. ..... 174/113 R; 174/117 F

(58) Field of Classification Search ..... 174/36, 174/117 F, 113 R, 112
See application file for complete search history.

(56) References Cited

U.S. PATENT DOCUMENTS

| | | | | |
|---|---|---|---|---|
| 3,333,049 | A * | 7/1967 | Humphrey et al. | 174/102 SC |
| 3,576,939 | A * | 5/1971 | Ziemek | 174/107 |
| 4,761,519 | A * | 8/1988 | Olson et al. | 174/107 |
| 4,767,891 | A * | 8/1988 | Biegon et al. | 174/34 |
| 5,038,001 | A * | 8/1991 | Koegel et al. | 174/112 |
| 5,072,193 | A * | 12/1991 | Wilson et al. | 330/66 |
| 5,414,211 | A * | 5/1995 | Chan | 174/36 |
| 5,710,393 | A * | 1/1998 | Smith et al. | 174/74 R |
| 5,739,472 | A * | 4/1998 | Buck et al. | 174/107 |
| 5,767,442 | A | 6/1998 | Eisenberg et al. | |
| 5,864,094 | A | 1/1999 | Griffin | |
| 6,580,034 | B2 * | 6/2003 | Daane et al. | 174/117 F |
| 6,734,362 | B2 * | 5/2004 | Buck et al. | 174/113 R |
| 7,271,340 | B2 * | 9/2007 | Buck et al. | 174/75 C |
| 2001/0053920 | A1 | 12/2001 | Shaker | |
| 2002/0033271 | A1 | 3/2002 | Fritschle et al. | |
| 2003/0085052 | A1 | 5/2003 | Tsao et al. | |

FOREIGN PATENT DOCUMENTS

| | | | |
|---|---|---|---|
| CN | 1192568 | A | 9/1998 |
| DE | 3721085 | A1 | 5/1989 |
| EP | 0136040 | A2 | 4/1985 |
| EP | 0243150 | B1 | 7/1992 |
| EP | 0645780 | A2 | 3/1993 |
| EP | 0718854 | A1 | 6/1996 |
| EP | 0734096 | A2 | 9/1996 |
| EP | 0778587 | A2 | 6/1997 |
| GB | 0241256 | A | 9/1980 |

(Continued)

*Primary Examiner* — Chau N Nguyen

(57) ABSTRACT

A cable assembly has a number of wires each having a central conductor and a surrounding insulating layer. Each wire is unshielded from the other wires, so that the conductor is the only conductive portion of the wire. Each wire has a first end and an opposed second end. The first ends of the wires are secured to each other in a flat ribbon portion in a first sequential arrangement, and the second ends of the wires are secured to each other in the same sequence as the first arrangement, with indicia identifying a selected wire in the sequence. The intermediate portions of the wires are detached from each other, and a sheath having a braided conductive shield may loosely encompass the wires, permitting significant flexibility of the cable.

17 Claims, 6 Drawing Sheets

FOREIGN PATENT DOCUMENTS

| | | | | |
|---|---|---|---|---|
| GB | 2041256 | A | | 9/1980 |
| GB | 2084811 | | * | 4/1982 |
| JP | 59-90119 | U | | 6/1984 |
| JP | 61-142607 | A | | 6/1986 |
| JP | 03-80920 | U | | 8/1991 |
| JP | 04-179007 | A | | 6/1992 |
| JP | 4-301320 | | * | 10/1992 |
| JP | 06-45215 | U | | 6/1994 |
| JP | 06-335481 | A | | 12/1994 |
| JP | 09-115345 | A | | 5/1997 |
| JP | 2000-516759 | A | | 12/2000 |
| JP | 2001-104311 | A | | 4/2001 |
| MX | 9504646 | A | | 4/1997 |
| WO | WO-02/080198 | A | | 10/2002 |

* cited by examiner

FLEXIBLE INTERCONNECT CABLE WITH RIBBONIZED ENDS

REFERENCE TO RELATED APPLICATION

This is a continuation of U.S. patent application Ser. No. 10/025,096, filed Dec. 18, 2001, now U.S. Pat. No. 6,580,034, entitled FLEXIBLE INTERCONNECT CABLE WITH RIBBONIZED ENDS, which is a Continuation-In-Part of U.S. patent application Ser. No. 09/822,550, filed Mar. 30, 2001, now abandoned.

FIELD OF THE INVENTION

This invention relates to multiple wire cables, and more particularly to small gauge coaxial wiring.

BACKGROUND OF THE INVENTION

Certain demanding applications require miniaturized multi-wire cable assemblies. To avoid undesirably bulky cables when substantial numbers of conductors are required, very fine conductors are used. To limit electrical noise and interference, coaxial wires having shielding are used for the conductors. A dielectric sheath surrounds a central conductor, and electrically separates it from the conductive shielding. A bundle of such wires is surrounded by a conductive braided shield, and an outer protective sheath.

Some applications requiring many different conductors prefer that a cable be very flexible, supple, or "floppy." In an application such as a cable for connection to a medical ultrasound transducer, a stiff cable with even moderate resistance to flexing can make ultrasound imaging difficult. However, with conventional approaches to protectively sheathing cables, the bundle of wires may be undesirably rigid.

In addition, cable assemblies having a multitude of conductors may be time-consuming and expensive to assemble with other components. When individual wires are used in a bundle, one can not readily identify which wire end corresponds to a selected wire at the other end of the bundle, requiring tedious continuity testing. Normally, the wire ends at one end of the cable are connected to a component such as a connector or printed circuit board, and the connector or board is connected to a test facility that energizes each wire, one-at-a-time, so that an assembler can connect the identified wire end to the appropriate connection on a second connector or board.

A ribbon cable in which the wires are in a sequence that is preserved from one end of the cable to the other may address this particular problem. However, with all the wires of the ribbon welded together, they resist bending, creating an undesirably stiff cable. Moreover, a ribbon folded along multiple longitudinal fold lines may tend not to generate a compact cross section, undesirably increasing bulk, and may not provide a circular cross section desired in many applications.

SUMMARY OF THE INVENTION

The present invention overcomes the limitations of the prior art by providing a cable assembly. The cable assembly has a number of wires each having a central conductor and a surrounding insulating layer. Each wire is unshielded from the other wires, so that the conductor is the only conductive portion of the wire. Each wire has a first end and an opposed second end. The first ends of the wires are secured to each other in a flat ribbon portion in a first sequential arrangement, and the second ends of the wires are secured to each other in the same sequence as the first arrangement, with indicia identifying a selected wire in the sequence. The intermediate portions of the wires are detached from each other, and a sheath having a braided conductive shield may loosely encompass the wires, permitting significant flexibility of the cable.

DETAILED DESCRIPTION OF A PREFERRED EMBODIMENT

Figure 1:
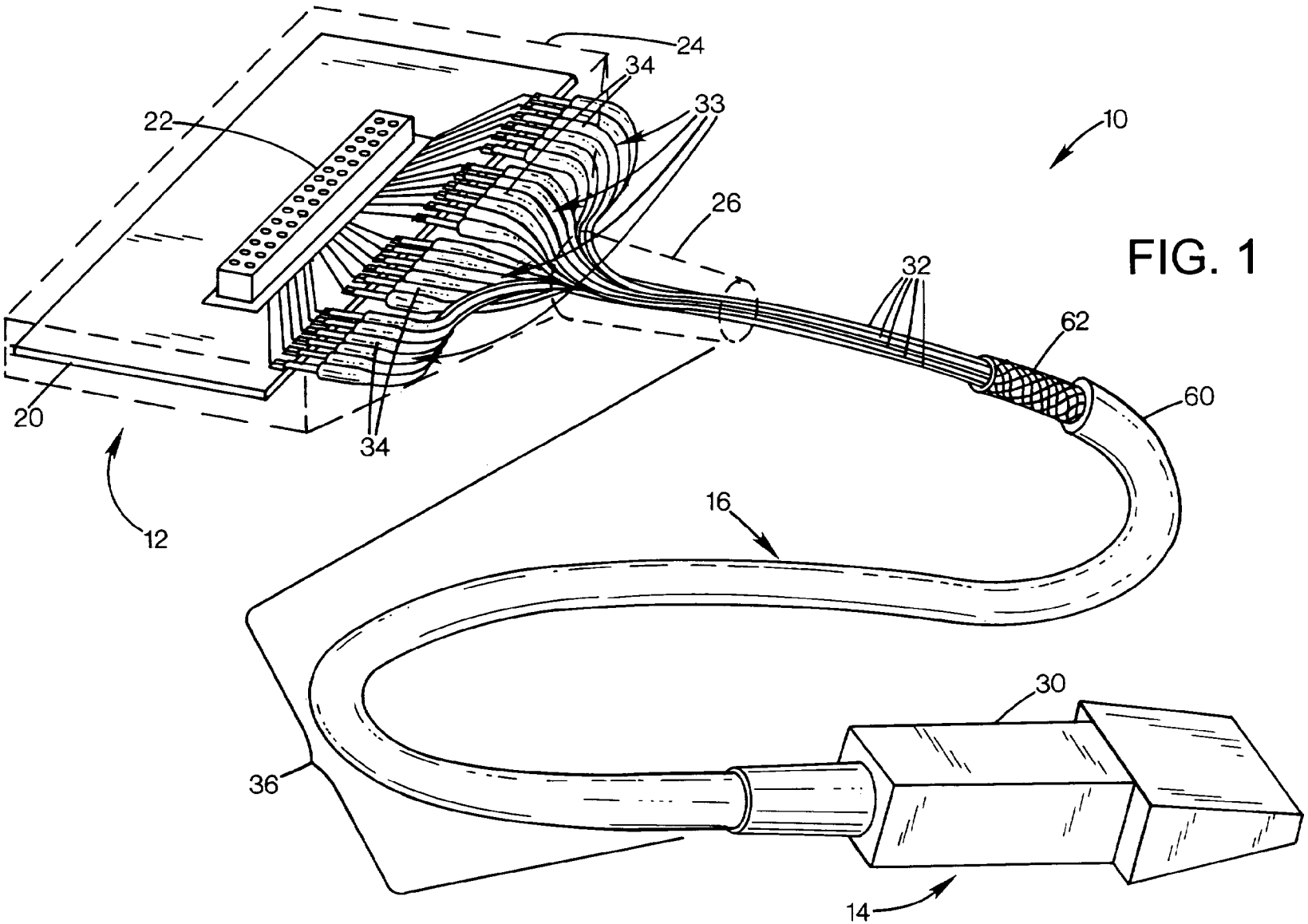
FIG. 1 is a perspective view of a cable assembly according to a preferred embodiment of the invention.

FIG. 1 shows a cable assembly 10 having a connector end 12, a transducer end 14, and a connecting flexible cable 16. The connector end and transducer ends are shown as examples of components that can be connected to the cable 16. In this example, the connector end includes a circuit board 20 with a connector 22 for connection to an electronic instrument such as an ultrasound imaging machine. The connector end includes a connector housing 24, and strain relief 26 that surrounds the end of the cable. On the opposite end, an ultrasound transducer 30 is connected to the cable.

Figure 2:
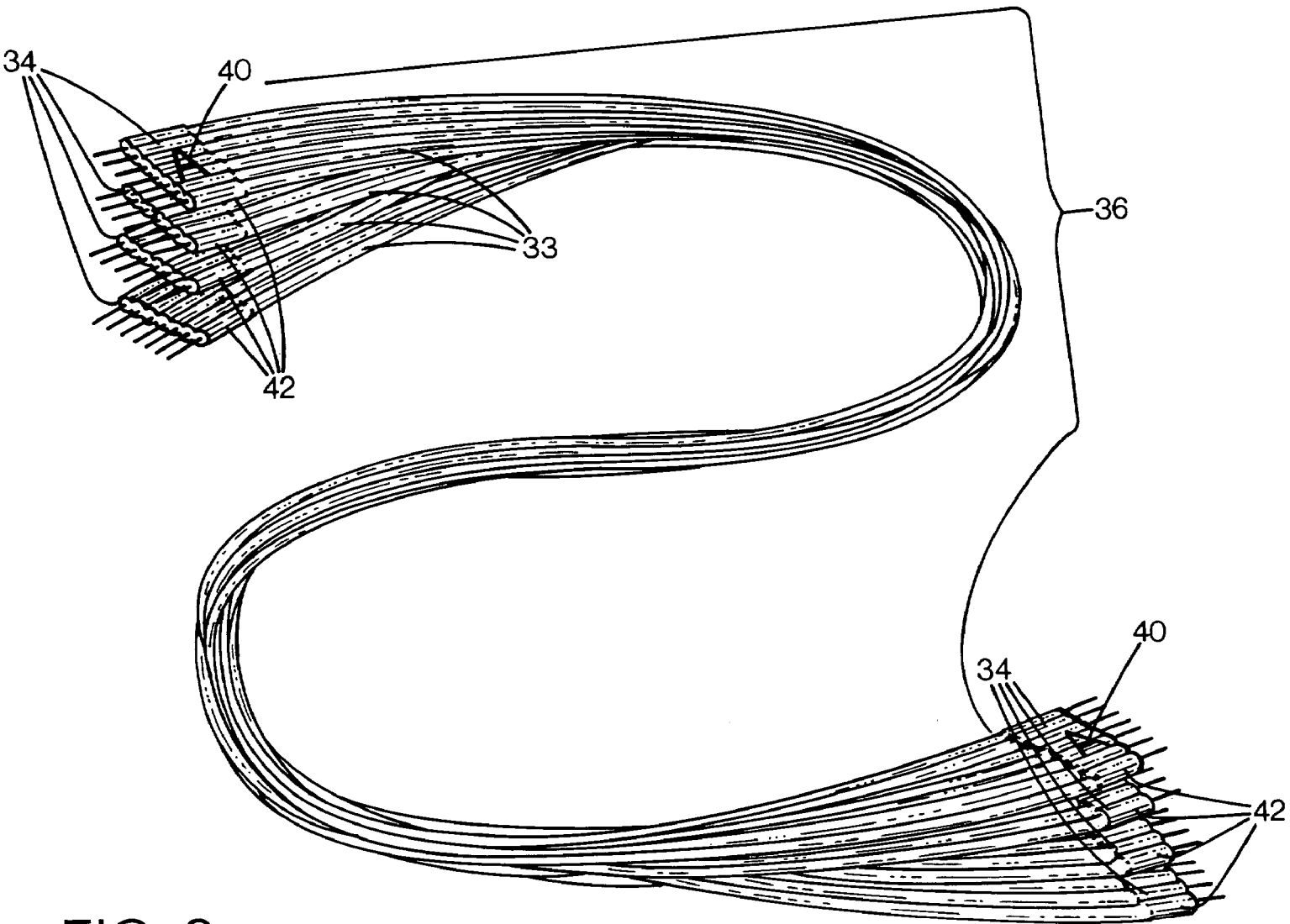
FIG. 2 is a perspective view of wiring components according to the embodiment of FIG. 1.

The cable 16 includes a multitude of fine coaxially shielded wires 32. As also shown in FIG. 2, the wires are arranged into groups 33, with each group having a ribbonized ribbon portion 34 at each end, and an elongated loose portion 36 between the ribbon portions and extending almost the entire length of the cable. Each ribbon portion includes a single layer of wires arranged side-by-side, adhered to each other, and trimmed to expose a shielding layer and center conductor for each wire. In the loose portion, the wires are unconnected to each other except at their ends.

The shielding and conductor of each wire are connected to the circuit board, or to any electronic component or connector by any conventional means, as dictated by the needs of the application for which the cable is used. The loose portions 36 of the wires extend the entire length of the cable between the strain reliefs, through the strain reliefs, and into the housing where the ribbon portions are laid out and connected.

The ribbon portions 34 are each marked with unique indicia to enable assemblers to correlate the opposite ribbon portions of a given group, and to correlate the ends of particular wires in each group. A group identifier 40 is imprinted on the ribbon portion, and a first wire identifier 42 on each ribbon portion assures that the first wire in the sequence of each ribbon is identified on each end. It is important that each group have a one-to-one correspondence in the sequence of wires in each ribbon portion. Consequently, an assembler can identify the nth wire from the identified first end wire of a given group "A" as corresponding to the nth wire at the opposite ribbon portion, without the need for trial-and-error continuity testing to find the proper wire. This correspondence is ensured, even if the loose intermediate portions 36 of each group are allowed to move with respect to each other, or with the intermediate portions of other groups in the cable.

Figure 3:
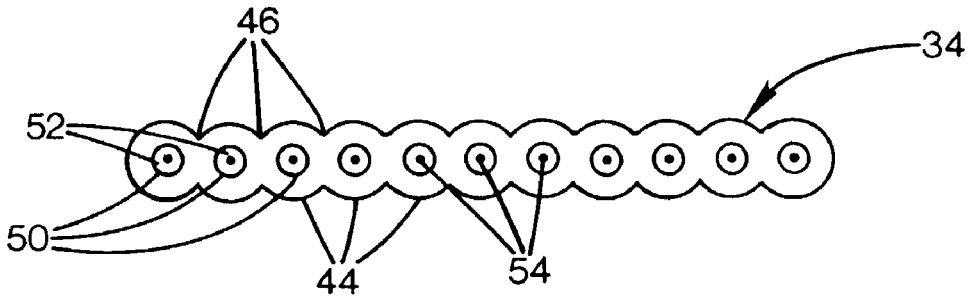
FIG. 3 is an enlarged sectional view of an end portion of a wiring component according to the embodiment of FIG. 1.

FIG. 3 shows a cross section of a representative end portion, with the wires connected together at their outer sheathing layers 44 at weld joints 46, while the conductive shielding 50 of each of the wires remains electrically isolated from the others, and the inner dielectric 52 and central conductors 54 remain intact and isolated. In alternative embodiments, the ribbon portions may be secured by the use of adhesive between abutting sheathing layers 44, by adhesion of each sheathing layer to a common strip or sheet, or by a mechanical clip.

Figure 4:
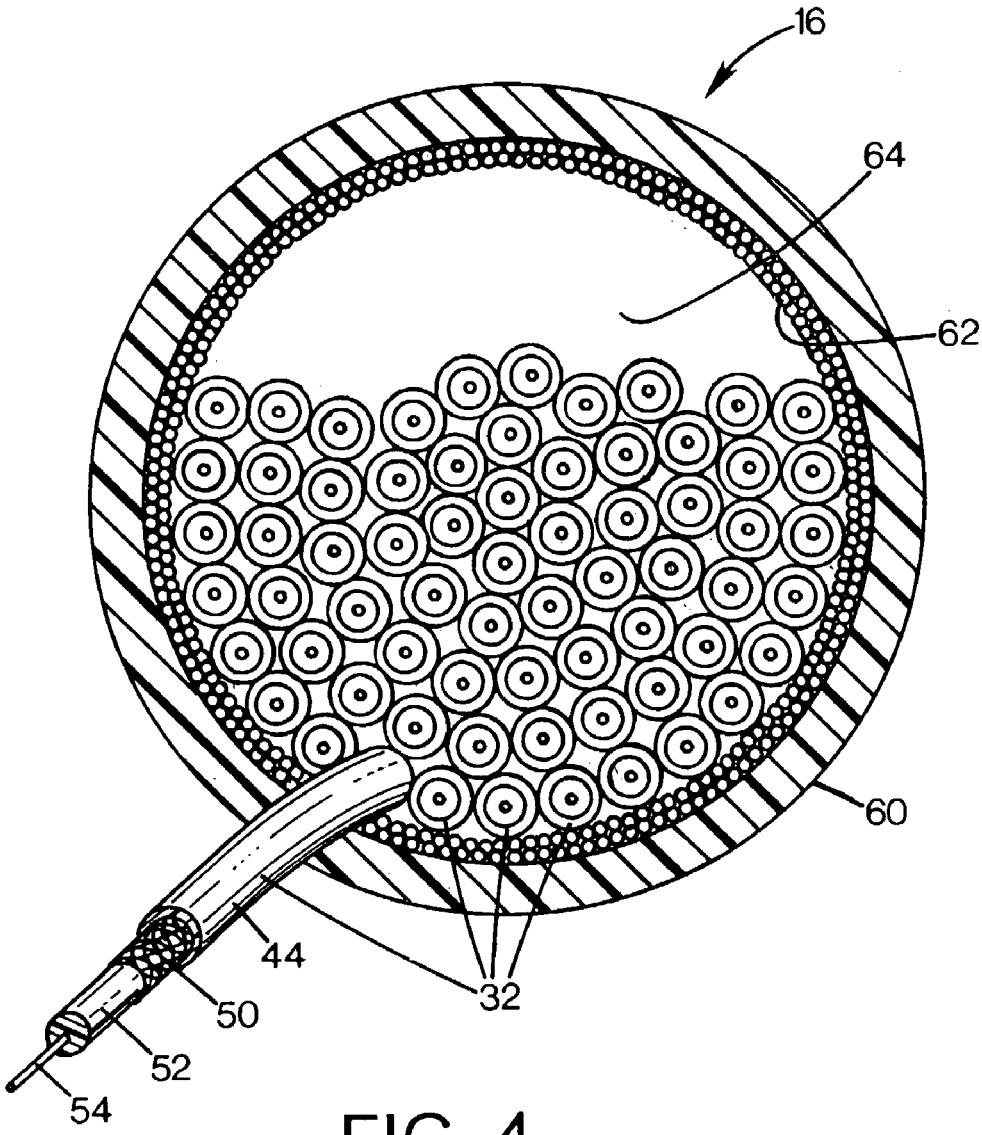
FIG. 4 is an enlarged sectional view of the cable assembly according to the embodiment of FIG. 1.
Figure 5:
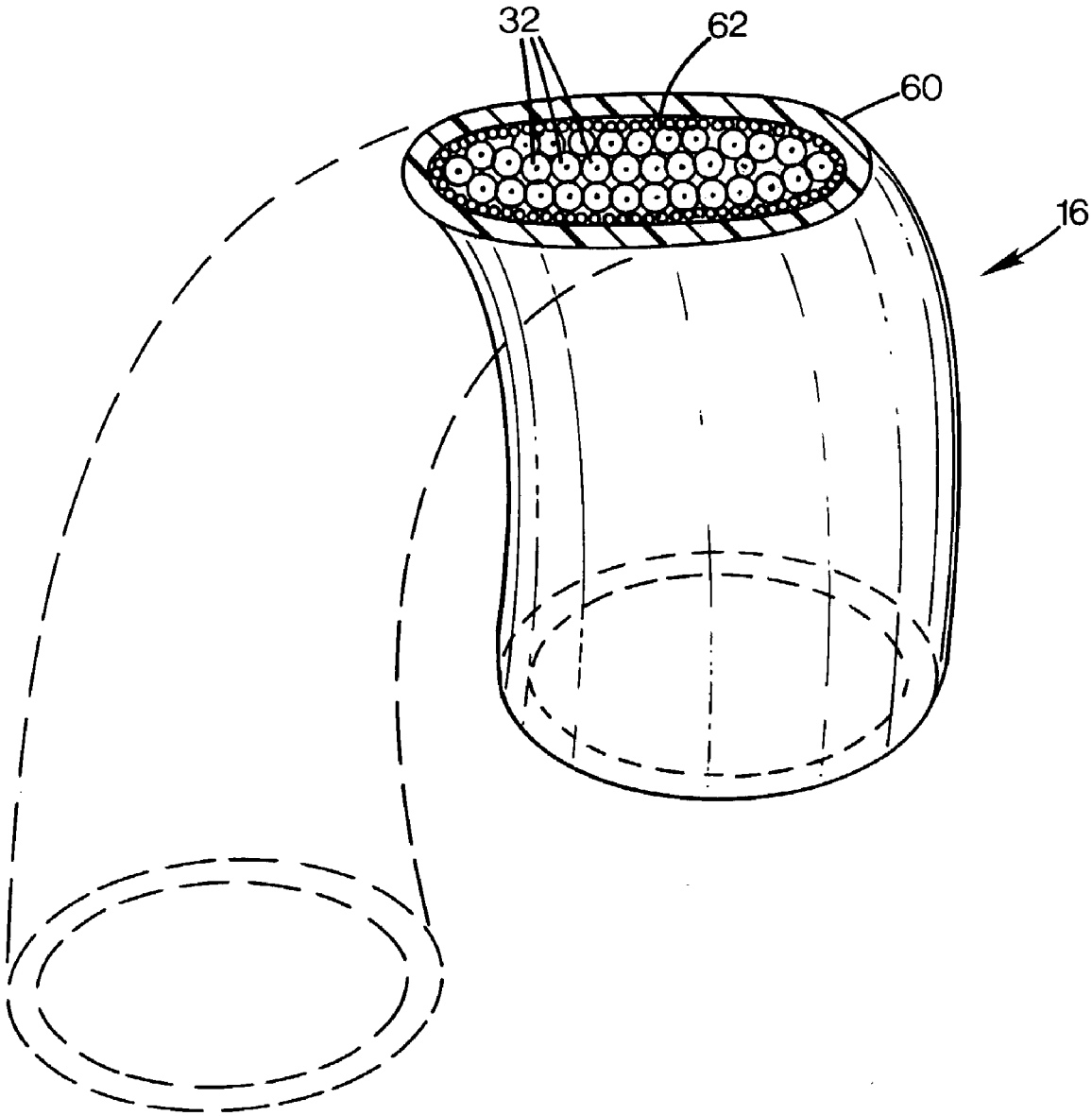
FIG. 5 is an enlarged sectional view of the cable assembly in a flexed condition according to the embodiment of FIG. 1.

FIG. 4 shows the cable cross section throughout most of the length of the cable, away from the ribbon portions, reflecting the intermediate portion. The wires are loosely contained within a flexible cylindrical cable sheath 60. As also shown in FIG. 1, a conductive braided shield 62 surrounds all the wires, and resides at the interior surface of the sheath to define a bore 64. Returning to FIG. 4, the bore diameter is selected to be somewhat larger than required to closely accommodate all the wires. This provides the ability for the cable to flex with minimal resistance to a tight bend, as shown in FIG. 5, as the wires are free to slide to a flattened configuration in which the bore cross section is reduced from the circular cross section is has when held straight, as in FIG. 4.

In the preferred embodiment, there are 8 groups of 16 wires each, although either of these numbers may vary substantially, and some embodiments may use all the wires in a single group. The wires preferably have an exterior diameter of 0.016 inch, although this and other dimensions may range to any size, depending on the application. The sheathing has an exterior diameter of 0.330 inch and a bore diameter of 0.270 inch. This yields a bore cross section (when straight, in the circular shape) of 0.057 inch. As the loose wires tend to pack to a cross-sectional area only slightly greater than the sum of their areas, there is significant extra space in the bore in normal conditions. This allows the wires to slide about each other for flexibility, and minimizes wire-to-wire surface friction that would occur if the wires were tightly wrapped together, such as by conventional practices in which a wire shield is wrapped about a wire bundle. In the preferred embodiment, a bend radius of 0.75 inch, or about 2 times the cable diameter, is provided with minimal bending force, such as if the cable is folded between two fingers and allowed to bend to a natural radius. Essentially, the bend radius, and the supple lack of resistance to bending is limited by little more than the total bending resistance of each of the components. Because each wire is so thin, and has minimal resistance to bending at the radiuses on the scale of the cable diameter, the sum of the wire's resistances adds little to the bending resistance of the sheath and shield, which thus establish the total bending resistance.

ALTERNATIVE EMBODIMENT

Figure 6:
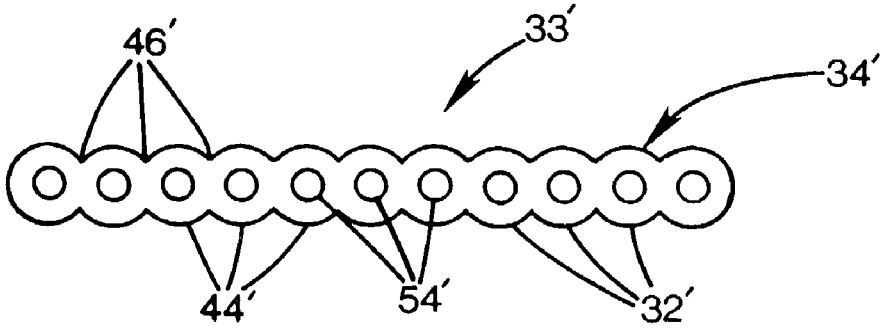
FIG. 6 is an enlarged cross-sectional view of a cable assembly component according to an alternative embodiment of the invention.

FIG. 6 shows a cross section of a representative end portion 34' of a wire group 33' according to an alternative embodiment of the invention. The alternative embodiment differs from the preferred embodiment in that the wires 32' that make up the cable are unshielded with respect to each other, and each have a central conductor 54' that comprises the only conductive portion of the wire. The central conductor 54' is surrounded only by a single insulation layer or dielectric sheath 44'. As in the preferred embodiment, the wires are connected together at their sheaths 44' at weld joints 46'. In alternative embodiments, the ribbon portions may be secured by the use of adhesive between abutting sheathing layers 44', by adhesion of each sheathing layer to a common strip or sheet, or by a mechanical clip.

Figure 7:
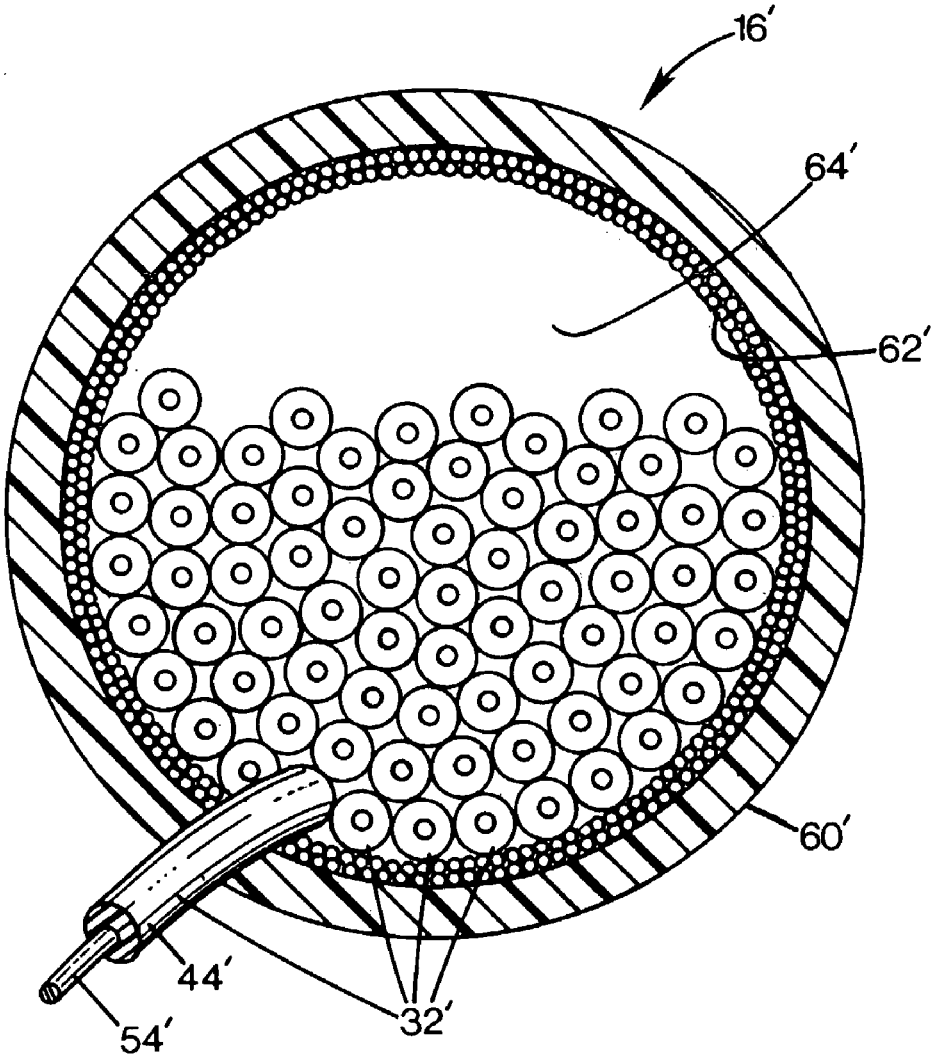
FIG. 7 is an enlarged cross-sectional view of a cable assembly according to the alternative embodiment of FIG. 6.

FIG. 7 shows an alternative embodiment cable 16' employing the cable groups 33' of FIG. 6. The section is taken at any intermediate location on the cable, away from the ribbon portions. The wires 32' are loosely contained within a flexible cylindrical cable sheath 60'. As with the preferred embodiment shown in FIG. 1, a conductive braided shield 62' surrounds all the wires, and resides at the interior surface of the sheath to define a bore 64'. Returning to FIG. 7, the bore diameter is selected to be somewhat larger than required to closely accommodate all the wires. This provides the ability for the cable to flex with minimal resistance to a tight bend, as shown in FIG. 5, as the wires are free to slide to a flattened configuration in which the bore cross section is reduced from the circular cross section is has when held straight, as in FIG. 6.

In the alternative embodiment, there are 8 groups of 16 wires each, although either of these numbers may vary substantially, and some embodiments may use all the wires in a single group. The wires have conductors that may either be single or stranded, and are insulated with a material suitable for ribbonization and with the desired dielectric constant. For cabling used in the exemplary ultrasound imaging application, typical conductor would be 38 to 42 AWG high strength copper alloy. Insulation would preferably be a low-density polyolefin, but using fluoropolymers is also feasible. The dielectric constant is preferably in the range of. 1.2 to 3.5.

A ribbonized end portion of the wires length of conductors is substantially exterior to cable jacket and shielding. The end portions are ribbonized at a pitch or center-to-center spacing that is uniform, and selected to match the pads of the circuit board to which it is to be attached. In an example of the alternative embodiment, the conductors have a diameter of 0.0031", and the insulation has a wall thickness of 0.0055", providing an overall wire diameter of 0.015". This is well-suited to provide an end-portion ribbonized pitch of 0.014".

The alternative embodiment has several performance differences from the preferred embodiment. The use of unshielded conductors yields a lower capacitance per foot. Comparing the above examples, the shielded version has a capacitance of 16/17 pF per foot, compared to 12 pF per foot in the unshielded non-coax alternative, using 40 AWG conductors in the example.

The unshielded alternative generally has a lower manufacturing cost, because there is no need for the materials and process costs to apply the shield and second dielectric layer. The unshielded alternative has a lower weight than the shielded version, with a typical weight of 21 grams per foot of cable, compared to 13.5 grams per foot in the unshielded version, a reduction of about ⅓.

It may normally be expected that unshielded conductors will yield unacceptably reduced crosstalk performance compared to coaxial conductors, particularly for the length of wire runs, small gauge of conductors, and close proximity of spacing. However, allowing the wires to remain loose through the majority of the cable length unexpectedly avoids this concern, common to normal ribbon cable. Because the wires are not connected to each other, and because there is adequate looseness of the cable sheath, the wires are allowed to move about, making it reliably unlikely that any two wires will remain closely parallel to each other, which would generate crosstalk problems. The flexing of the cable with use has the effect of shuffling the wires, so that none can be expected to remain adjacent to the same other wires over the entire cable length. With the controlled and organized ribbonization only at the ends, the one-to-one mapping allows connections to reliably and efficiently made, as discussed above.

Figure 8:
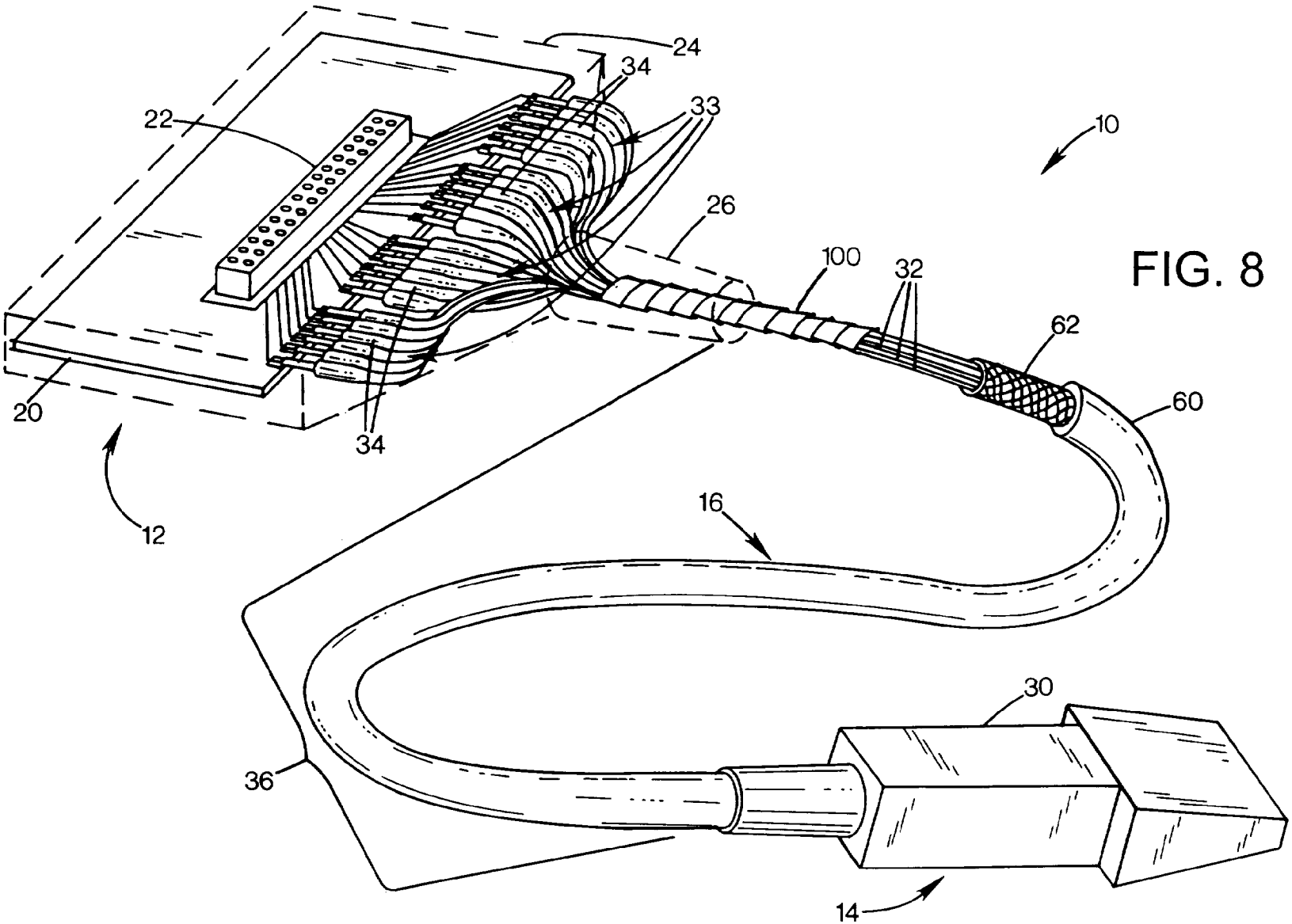
FIG. 8 is a perspective view of a cable assembly according to an alternative embodiment of the invention.

As shown in FIG. 8, either the preferred or alternative embodiment may be provided with a spiral wrap of flexible tape 100. The tape is wrapped about an end portion of the wires near the connector 12, but just before the wires diverge from the bundle to extend to the ribbonized portions 34. This tape wrap serves as a barrier to reduce the wearing and fatigue effects of repeated cable flexure, which is a particular concern for handheld corded devices. The wrapped portion thus extends the useful life of the cable. The wrapped barrier is applied at the end of the cable where repeated bending occurs. The barrier preferably extends over a length of approximately one foot. It has been demonstrated that wrapping the area with expanded PTFE tape is effective in providing long flex life, while not degrading the flexibility of the cable significantly. Preferably, the tape has a width of 0.5", a thickness of 0.002" a wrap pitch of 0.33", and is wrapped with a limited tension of 25 grams, so as to avoid a tight bundle with limited flexure.

While the above is discussed in terms of preferred and alternative embodiments, the invention is not intended to be so limited.

The invention claimed is:

1. A cable assembly comprising:

a plurality of wires, each having a first end and an opposed second end;

the wires having intermediate portions between the first and second ends, the intermediate portions being detached from each other;

a sheath containing a conductive shield loosely encompassing all the wires;

the shield being flexible in cross section, such that the wires adopt a flattened configuration when the cable is flexed;

wherein the intermediate portions of the wires are loosely received within the sheath; and wherein the wires are free to move about with respect to each other within the shield.

2. The cable assembly of claim 1 wherein the conductive shield defines a bore having a first cross sectional area, and the intermediate portions of the wires form a bundle having periphery with a lesser second cross sectional area.

3. The cable assembly of claim 1 wherein the conductive shield defines a bore, and wherein the intermediate portions of the wires form a bundle having peripheral members, at least some of which are spaced apart from the bore.

4. The cable assembly of claim 1 wherein the wires comprise a bundle spaced apart from at least a portion of the shield.

5. The cable assembly of claim 1 wherein at least a portion of the shield is apart from all of the wires such that the wires are free to move about with respect to each other.

6. The cable assembly of claim 1 wherein the conductive shield defines a bore, the intermediate portions of the wires form a bundle, and wherein the bundle partially occupies the bore to define a bore space.

7. The cable assembly of claim 1 wherein the bundle has a cross sectional area dimensionally unconstrained by the shield.

8. The cable assembly of claim 1 wherein the bundle is in a relaxed condition, such that none of the wires are biased against the shield.

9. The cable assembly of claim 1 wherein the intermediate portions of the wires are unbiased with respect to the shield.

10. The cable assembly of claim 1 wherein the first ends of the wires are secured to each other in a first sequential arrangement and the second ends of the wires being secured to each other in a second sequential arrangement based on the first arrangement.

11. The cable assembly of claim 1 wherein the first and second ends are ribbonized.

12. The cable assembly of claim 1 wherein the first ends of the wires are arranged in parallel, adjacent to each other, in a selected sequence, and the second ends of the wires are arranged in parallel, adjacent to each other, in the selected sequence.

13. The cable assembly of claim 12 including indicia on the first end and on the second end, identifying respective ends of a first one of the wires in the sequence.

14. The cable assembly of claim 1 wherein the wires are grouped into sets of wires, the wires being secured within each set, and the sets being detached from each other.

15. The cable assembly of claim 1 wherein the assembly is operable to generate a flattened cross section when flexed substantially.

16. The cable assembly of claim 1 wherein the shield resides at the interior of the sheath, such that there is no gap between the shield and the sheath.

17. The cable assembly of claim 1 wherein the shield is formed of a plurality of flexible wires.

* * * * *